US006671380B2

(12) United States Patent
Chang et al.

(10) Patent No.: US 6,671,380 B2
(45) Date of Patent: Dec. 30, 2003

(54) ACOUSTIC TRANSDUCER WITH SPIRAL-SHAPED PIEZOELECTRIC SHELL

(75) Inventors: Chung Chang, Wilton, CT (US); Hiroshi Hori, Sagamihara (JP)

(73) Assignee: Schlumberger Technology Corporation, Ridgefield, CT (US)

( * ) Notice: Subject to any disclaimer, the term of this patent is extended or adjusted under 35 U.S.C. 154(b) by 293 days.

(21) Appl. No.: 09/793,685

(22) Filed: Feb. 26, 2001

(65) Prior Publication Data

US 2002/0118849 A1 Aug. 29, 2002

(51) Int. Cl.[7] ..... H04R 25/00
(52) U.S. Cl. ..... 381/190; 310/367
(58) Field of Search ..... 381/190, 173; 310/337, 367, 369, 333, 355, 328, 800, 358

(56) References Cited

U.S. PATENT DOCUMENTS

| | | | | |
|---|---|---|---|---|
| 3,781,955 A | * | 1/1974 | Lavrinenko et al. | 310/330 |
| 3,827,023 A | | 7/1974 | Henriquez et al. | 340/10 |
| 4,376,302 A | | 3/1983 | Miller | 367/157 |
| 4,435,667 A | * | 3/1984 | Kolm et al. | 310/367 |
| 4,500,377 A | | 2/1985 | Broussoux et al. | 156/164 |
| 5,122,992 A | | 6/1992 | Kompanek | 367/159 |
| 5,631,040 A | * | 5/1997 | Takuchi et al. | 310/363 |

FOREIGN PATENT DOCUMENTS

| | | | |
|---|---|---|---|
| JP | 60121899 | 6/1985 | H04R/17/00 |
| JP | 60264200 | 12/1985 | H04R/17/00 |

OTHER PUBLICATIONS

Basic Designs of Piezoelectric Positioning Elements located at http://www.physikinstrumente.com/tutorial/4_41.html (Feb. 15, 2001).

* cited by examiner

*Primary Examiner*—Curtis Kuntz
*Assistant Examiner*—Brian Ensey
(74) *Attorney, Agent, or Firm*—John L. Lee; Jody Lynn DeStefanis; William B. Batzer

(57) ABSTRACT

An acoustic transducer includes a polarized piezoelectric shell having a spiral-shaped surface. The acoustic transducer serves as a receiver or a transmitter.

In one embodiment, the acoustic transducer includes a solid spiral shell having outer and inner spiral-shaped surfaces, and the shell is polarized, wired and packaged to operate in hydrophone-mode.

In another embodiment, the acoustic transducer includes a shell defining an exterior spiral-shaped surface and a spiral slot; and the slot defines a closed cavity with an interior spiral-shaped surface. In a preferred bender-type receiver embodiment, the shell is polarized, wired, and packaged to operate in bender mode for maximum sensitivity and best low-frequency performance.

6 Claims, 8 Drawing Sheets

ACOUSTIC TRANSDUCER WITH SPIRAL-SHAPED PIEZOELECTRIC SHELL

TECHNICAL FIELD

The present invention relates to apparatus and methods for acoustic transducer technology for oil field and underwater applications, and more particularly to improvements in piezoelectric transmitters and receivers for oil field acoustic logging applications.

BACKGROUND OF THE INVENTION

Modern oil field acoustic logging involves sonic imaging of objects outside the borehole. This is accomplished by transmitting an acoustic signal along the borehole and detecting signals reflected back from objects outside the borehole. The reflected signal is subject to severe attenuation in this process and is typically very weak compared to the signal transmitted down the borehole.

Traditional sonic logging acquisition systems typically measure guided borehole waves that do not suffer such severe attenuation. Detecting the much weaker reflected signals from reflectors outside the borehole requires a more sensitive receiver, or a more powerful transmitter, or both.

Larger receivers or multiple receiving elements (e.g., stacked piezoelectric plates) of the prior art can be used to increase sensitivity and improve low-frequency response. However, for oil field logging application, particularly for acoustic receivers used in wireline and LWD acoustic logging, available space is limited. Available space is further limited by the need to place receivers in an azimuthal array for azimuthal resolution.

There is a large mismatch in acoustic impedance between borehole fluid and piezoelectric ceramics. Both the shape and the packaging of the piezoelectric ceramics affect the severity and frequency characteristics of the acoustic disturbance introduced by the mismatch. Receivers having larger surface area can be used to reduce the effects of mismatch. However, larger surface area in prior art receiver designs is only achievable at the expense of larger size. Also, receivers used for oil field logging must be designed to withstand the extremely high pressures experienced near the bottom of a borehole.

The prior art hydrophone best suitable for use as a receiver in wireline and LWD acoustic logging is the traditional cylindrical shape hydrophone disclosed in U.S. Pat. No. 3,327,023, "Piezoelectric Transducer Having Good Sensitivity Over A Wide Range Of Temperature And Pressure", issued Jul. 30, 1974, to Henriquez, et al. Another cylindrical shape hydrophone is disclosed in U.S. Pat. No. 5,122,992, "Transducer Assembly", issued Jun. 16, 1992, to Kompanek.

Other prior art acoustic receivers known as "benders" offer higher sensitivity, but lack the omni-directional capability of the hydrophone.

Available prior art acoustic transmitters most suitable for use in wireline and LWD acoustic logging are phased array transmitters, but these are inherently large for a given power output. More powerful transmitters of a given size would facilitate improvements in system sensitivity of wireline and LWD acoustic logging systems. In particular, there is a need for a high-power, pressure-balanced, acoustic transmitter small enough to fit in a logging tool.

There is a need to improve signal to noise ratio of downhole acoustic detection, and to improve low-frequency response. Thus, the need exists for more powerful transmitters and smaller, more sensitive, receivers with improved low-frequency response, both transmitters and receivers having higher capacitance and being better matched to the impedance of downhole borehole fluid.

SUMMARY OF THE INVENTION

The invention provides an acoustic transducer including a polarized piezoelectric shell having a spiral-shaped surface. The acoustic transducer may be used in a receiver or a transmitter. In one embodiment, the shell is a solid spiral having outer and inner spiral-shaped surfaces. In a preferred bender-type receiver embodiment, the shell defines an exterior, spiral-shaped, closed-loop surface and a spiral slot. The spiral slot defines a closed cavity with an interior, spiral-shaped, closed-loop surface.

DETAILED DESCRIPTION

General

The present invention provides an acoustic transducer having a spiral-shaped piezoelectric shell, the transducer being of a type suitable for use in a transmitter or in a receiver for oil field logging and other applications.

A hydrophone-type receiver embodiment provides a small, sensitive, acoustic receiver having a spiral-shaped piezoelectric shell.

A preferred bender-type receiver embodiment provides a small, sensitive, acoustic receiver having a spiral-shaped, closed-loop, piezoelectric shell.

A hydrophone-type transmitter embodiment provides a powerful acoustic transmitter having a spiral-shaped piezoelectric shell.

A bender-type acoustic transmitter embodiment provides a powerful transmitter having a spiral-shaped, closed-loop, piezoelectric shell.

First Hydrophone-Type Receiver Embodiment

Figure 1:
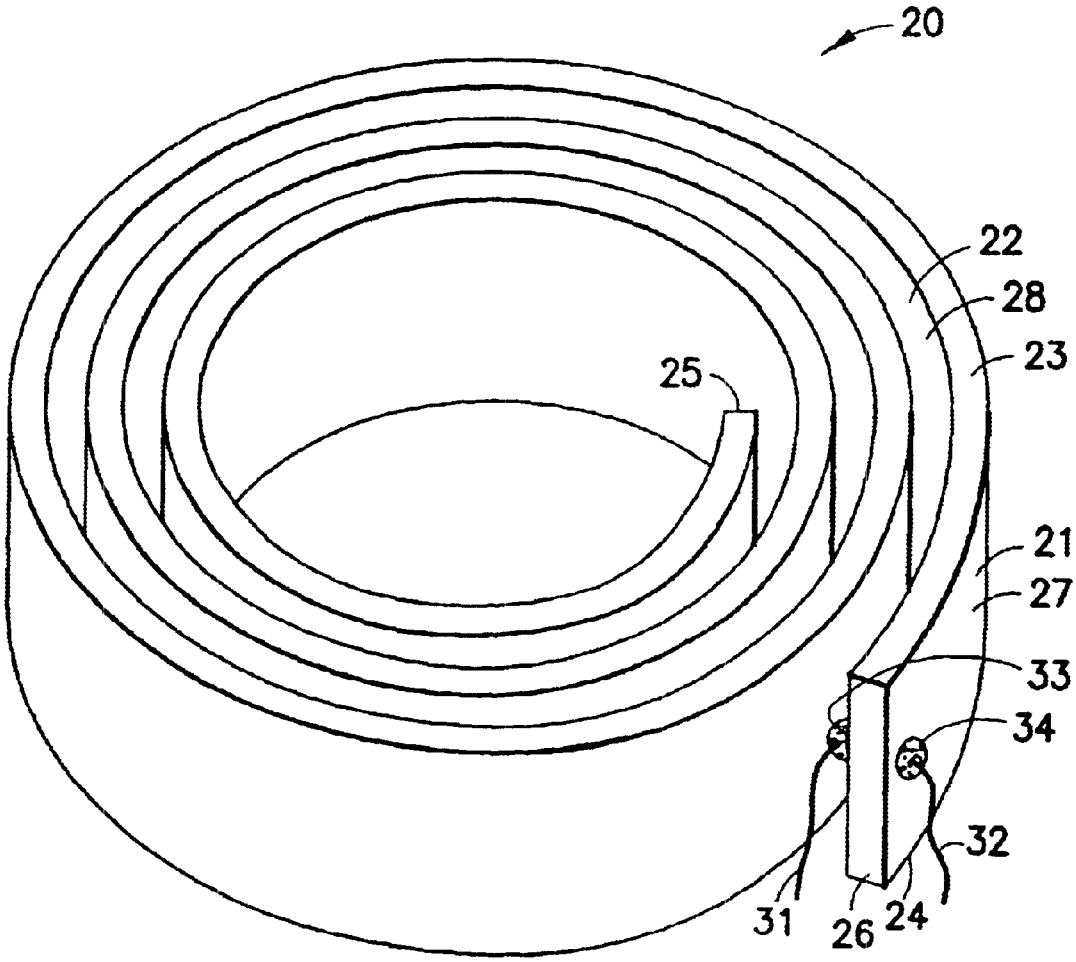
FIG. 1 is a perspective view of piezoelectric shell of a first hydrophone-type receiver embodiment of the present invention.

FIG. 1 shows spiral-shaped piezoelectric shell 20. Shell 20 is used in a first hydrophone-type embodiment of a transducer of the present invention. This first hydrophone-type embodiment, receiver 50, is configured for use as a small, sensitive, high-capacitance receiver. Receiver 50 is illustrated generally in FIGS. 2A and 2B. Receiver 50 is responsive to low-energy impinging acoustic energy to provide representative electrical signals.

FIG. 1 shows the geometry of shell 20. Receiver 50 includes an outer electrically conductive coating 27 deposited on outer spiral-shaped surface 21 and a separate, inner electrically conductive coating 28 deposited on inner spiral-shaped surface 22. Outer conductive coating 27 is deposited on outer spiral-shaped surface 21 of shell 20 to provide an electrical connection covering essentially the whole surface of outer spiral-shaped surface 21. Inner electrically conductive coating 28 is deposited on inner spiral-shaped surface 22 of shell 20 to provide an electrical connection covering essentially the whole surface of inner spiral-shaped surface 22. First axial end surface 23, second axial end surface 24, inner end 25, and outer end 26 have no metallic coating, so as to maintain electrical isolation between outer coating 27 and inner coating 28. Spiral-shaped surfaces 21 and 22 have a linear axial cross section, as illustrated in FIG. 1 by the longer edge of outer end 26.

Shell 20 is radially polarized in the manufacturing process by applying a strong electric field between outer coating 27 and inner coating 28.

Shell 20, in a first receiver embodiment, is approximately 2 cm in maximum diameter. Its spiral-shaped strip is approximately 6 mm wide and 2 mm thick. The gap between spiral layers is approximately 3 mm. Shell 20 has approximately 1.5 turns, and preferably a number of turns between 1.1 and 3.0. The maximum diameter, the width and thickness of the spiral strip, the gap, and number of turns can be selected to meet design requirement specifications for bandwidth, sensitivity, and electric noise.

Figure 2A:
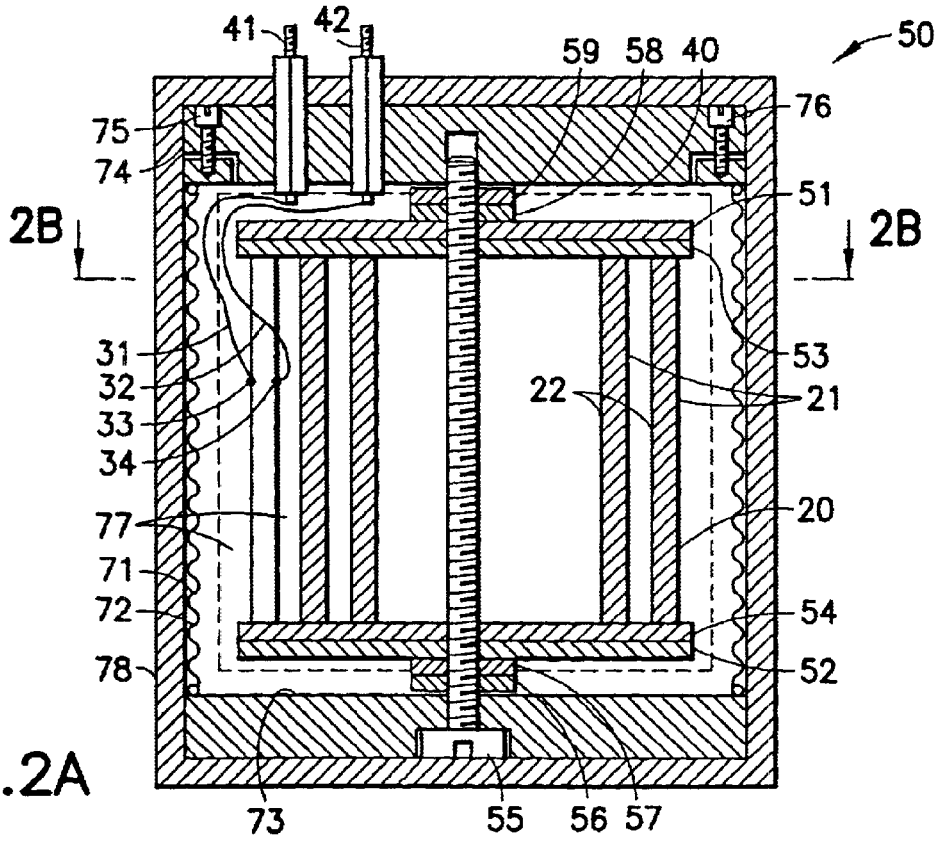
FIG. 2A is a cross-sectional, elevation view of a hydrophone-type receiver including the piezoelectric shell of FIG. 1.
Figure 2B:
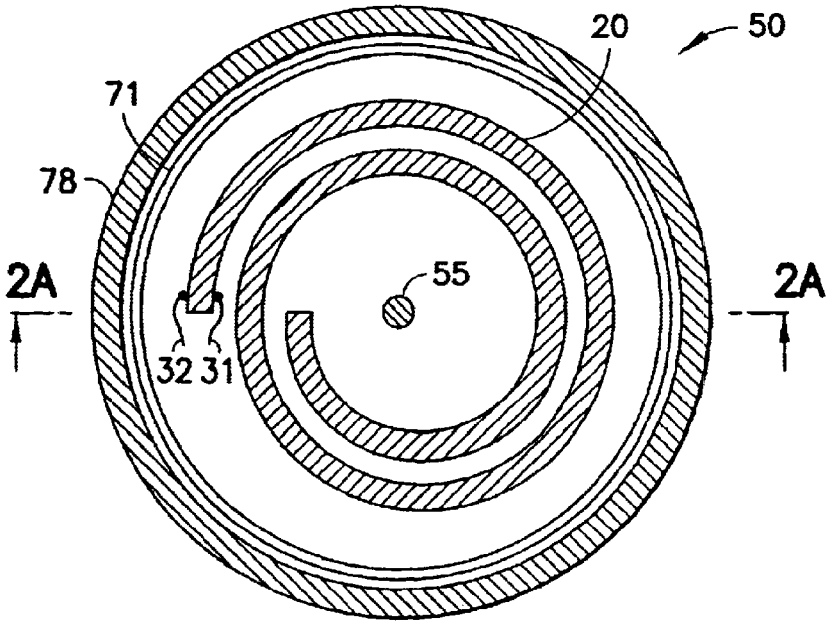
FIG. 2B is a cross-sectional, top view of the transducer assembly of FIG. 2A.

Hydrophone-type receiver 50 is shown in cross-sectional elevation view in FIG. 2A, and in cross-sectional top view in FIG. 2B. FIG. 2A shows shell 20 clamped between end plates 51 and 52. End plates 51 and 52 are preferably made of steel. The end plates serve as protective end caps, and provide mechanical support to the shell. Teflon plates 53 and 54, located between the plates and the shell, provide electrical insulation between the steel plates and the conducting surfaces of the shell. The Teflon also prevents acoustic waves from passing directly in fill-fluid from one side of the spiral strip to the other. The two plates are clamped together by bolt 55, nuts 56 and 58, and lock nuts 57 and 59, to form transducer assembly 40.

Transducer assembly 40 is enclosed within bellows assembly 71 and protective butyl rubber housing 78 to make hydrophone-type receiver 50.

Shell 20 is mounted between the flat surfaces of Teflon plates 53 and 54, the flat surfaces providing a sealing contact with flat axial end surfaces 23 and 24 of the shell. The enclosure in which transducer 40 is mounted is filled with fill-fluid, the fill-fluid occupying all spaces between the coils of the shell. Note that the open spiral acoustic path through fill-fluid between outer electrically conductive coating 27 and inner electrically conductive coating 28 is a narrow, elongated path. The longer and narrower the path, the less low frequency performance is degraded.

Bellows assembly 71 comprises thin cylindrical metal bellows 72, bellows base plate 73, and bellows cover plate 74. Cover plate 74 is attached to thin cylindrical metal bellows 72 after transducer assembly 40 has been installed and fastened within cylindrical bellows 72 using nut 58 and lock nut 59. Cover plate 74 is attached to cylindrical bellows 72 and sealed with a gasket (not shown) by screws 75 and 76, after the bellows cavity is filled with a suitable fill-fluid 77. The fill-fluid is preferably castor oil.

Electrical connection to outer spiral-shaped surface 21 of shell 20 is made by wire 31 which is welded to outer spiral-shaped surface 21 by weld 33. Likewise, electrical connection to inner spiral-shaped surface 22 of shell 20 is made by wire 32. Wire 32 is welded to inner spiral-shaped surface 22 by weld 34. Alternatively, metal end caps are used to make these electrical connections.

Wires 31 and 32 are electrically connected through the bellows cavity, through a seal in bellows cover plate 74, and through housing 78, to first and second electrical output terminals 41 and 42, respectively.

Damping layers (not shown) may be provided to further protect the hydrophone or to increase the bandwidth.

Making the Spiral Piezoelectric Shell

Figure 3A:
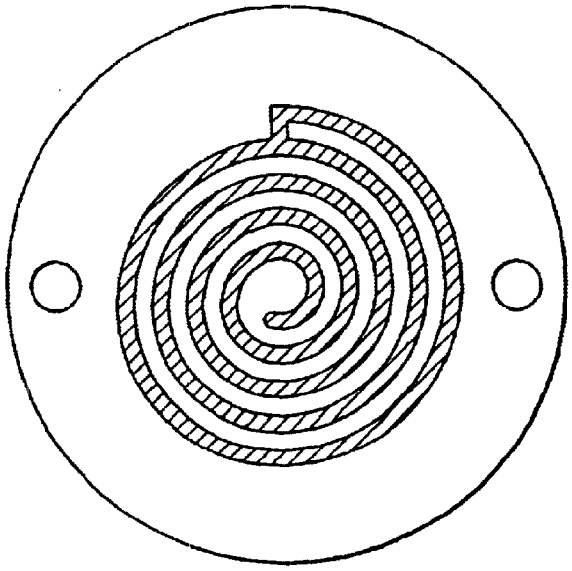
FIGS. 3A, 3B, and 3C show the pieces produced in the process of cutting a spiral piezoelectric shell from a PZT disk.
Figure 3B:
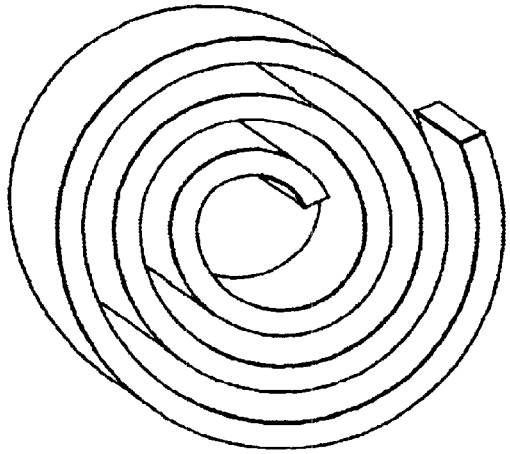
Figure 3C:
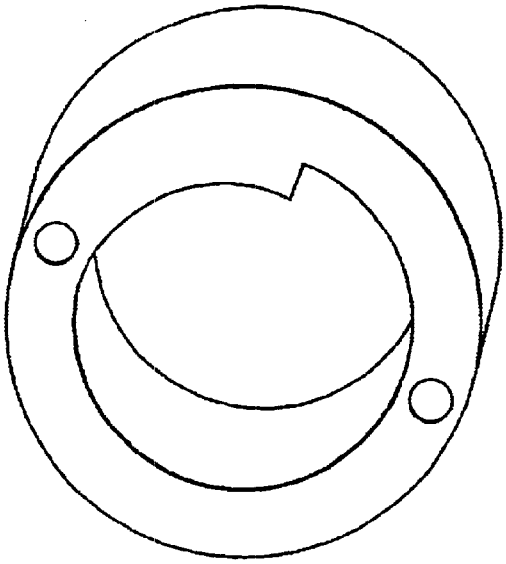

One method of making a spiral piezoelectric shell is to cut a solid disk of piezoelectric material, preferably PZT, using the high-pressure water jet cutting method. A disadvantage of using this cutting technique is that the spread of the high-pressure jet beam produces a gentle tapering of thickness along the cutting direction, and the tapering angle tends to increase as the thickness of the sample increases. Therefore, the maximum height of the hydrophone that stays within the machining tolerance is limited. FIGS. 3A, 3B, and 3C show the pieces produced by cutting a spiral piezoelectric shell from a PZT disk using the high-pressure water jet cutting method.

The preferred method of making a spiral piezoelectric shell is to cut a solid disk of piezoelectric material using a diamond-impregnated wire. This method does not introduce thickness taper along the cutting direction and is expected to produce less surface damage.

Second, Preferred, Bender-Type Receiver Embodiment

Figure 4A:
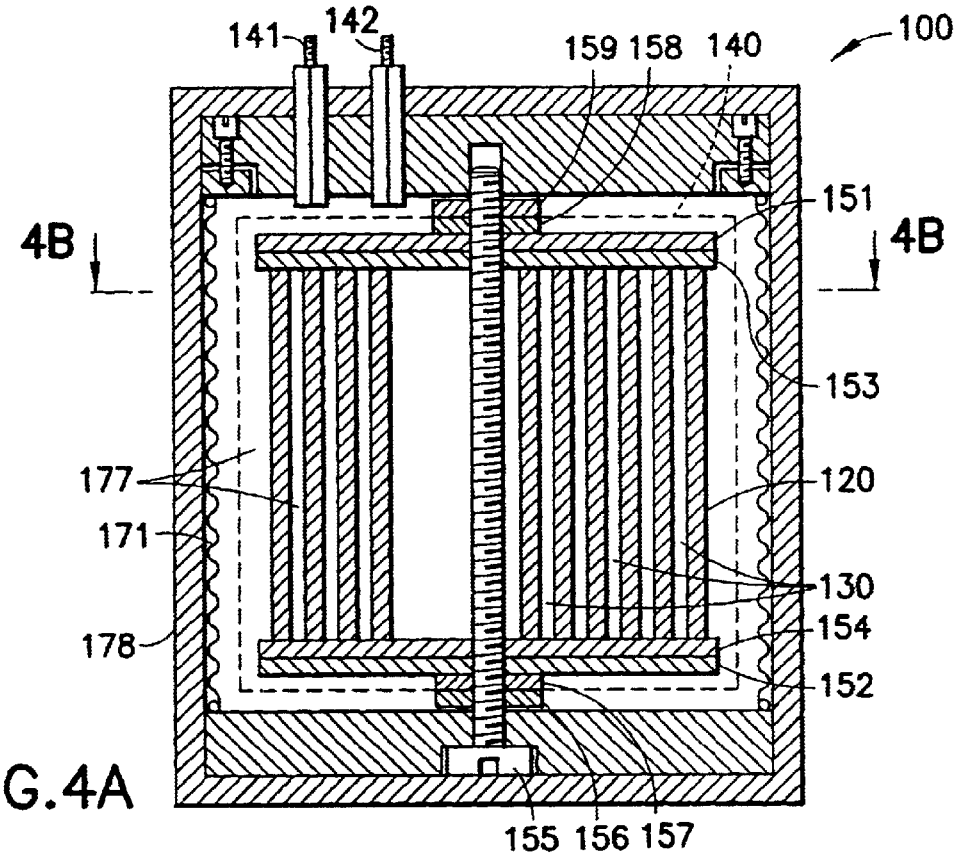
FIG. 4A is a cross-sectional, elevation view of a second, preferred, bender-type receiver embodiment, including a closed, spiral-shaped piezoelectric shell.
Figure 4B:
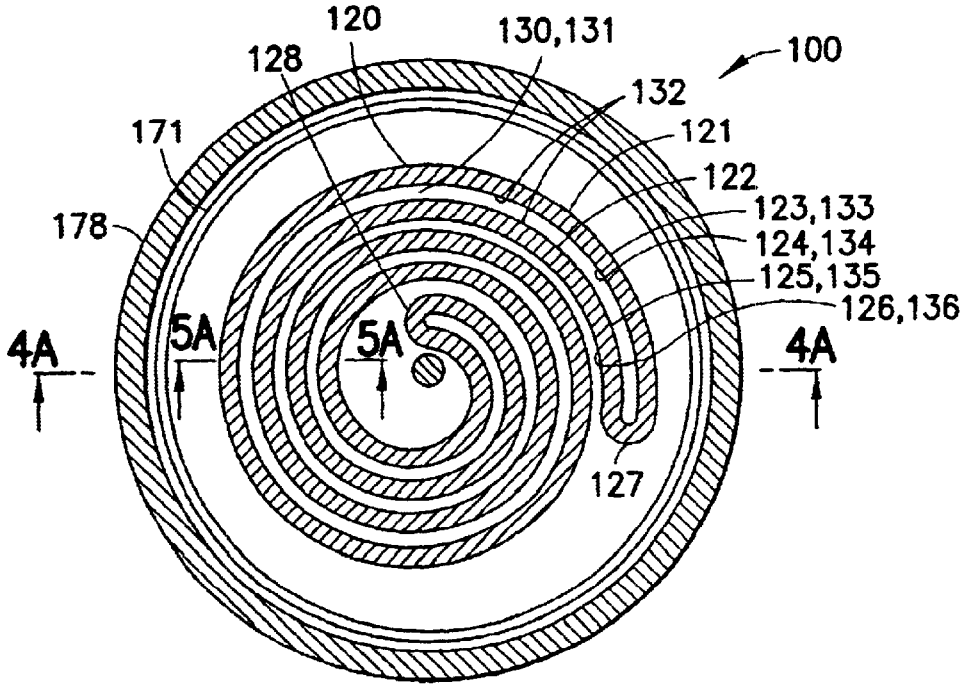
FIG. 4B is a partially cut-away, cross-sectional top view of the preferred second receiver embodiment, showing exterior and interior spiral surfaces with conductive coatings.

A second, preferred, bender-type receiver embodiment of a spiral piezoelectric transducer of the present invention, configured for use as a small, sensitive, high-capacitance receiver, is shown in FIGS. 4A and 4B. Bender-type receiver 100 is responsive to low-energy impinging acoustic energy to provide representative electrical signals.

FIGS. 4A and 4B show receiver 100 including piezoelectric shell 120. FIG. 4B shows piezoelectric shell 120 having an elongated spiral slot 130. Slot 130 dividing the spiral shell into outer spiral portion 121 and inner spiral portion 122.

Outer spiral portion 121 has an outer, exterior, spiral-shaped, closed-loop surface 123, and an outer interior, spiral-shaped, closed-loop surface 124, as indicated in FIG. 4B. Inner spiral portion 122 has an inner, interior, spiral-shaped, closed-loop surface 125, and an inner, exterior, spiral-shaped, closed-loop surface 126, also indicated in FIG. 4B. On each of these surfaces, is deposited a conductive coating, preferably metallic. Thus, surfaces 123–126 are coated with conductive coatings 133–136, respectively. To maintain electrical isolation between the four conductive coatings, coatings 133–136 do not cover either the outer end 127 or the inner end 128 of the shell. Thus we have four electrically isolated conductive coatings: outer, exterior conductive coating 133, outer, interior conductive coating 134, inner, interior conductive coating 135, and inner, exterior conductive coating 136.

Figure 5A:
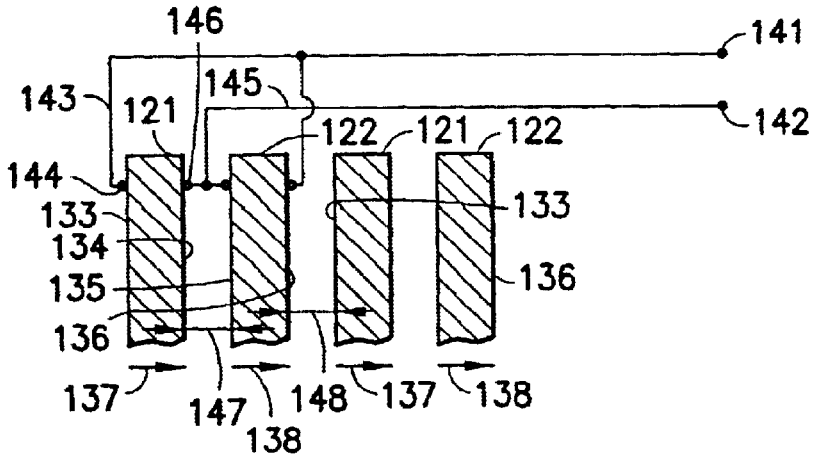
FIG. 5A is a cross-sectional, view of a portion of the shell of the preferred second bender-type receiver embodiment of FIG. 4A, also showing the polarization of the shell, and the electrical connections for parallel bender configuration.
Figure 5B:
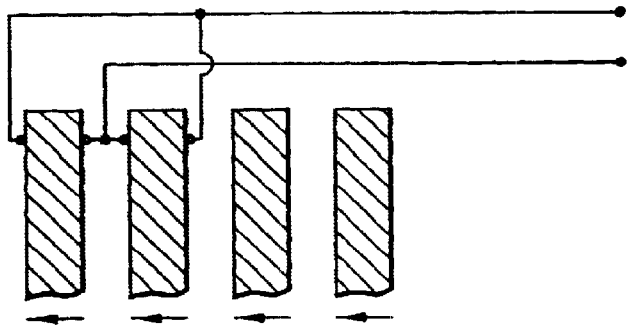
FIG. 5B is the same cross-sectional view as FIG. 5A, but showing polarization reversed.

FIG. 4A shows first output terminal 141 and second output terminal 142. In the preferred receiver embodiment, operating in bender mode, electrical connections are provided between conductive coatings 133–136 and output terminals 141 and 142 as shown in FIG. 5A. FIG. 5A also shows the polarity of shell outer portion 121 and shell inner portion 122. FIG. 5B shows the same electrical configuration as FIG. 5A but with the polarization of each shell portion reversed. This would simply reverse the polarity of the electrical output signals.

Figure 5C:
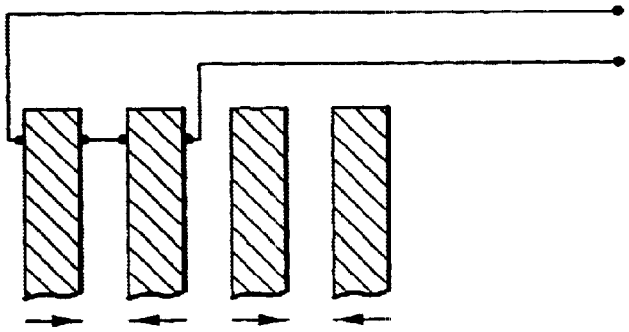
FIGS. 5C and 5D show the receiver of FIGS. 5A and 5B with polarization and electrical connections for serial bender configuration.
Figure 5D:
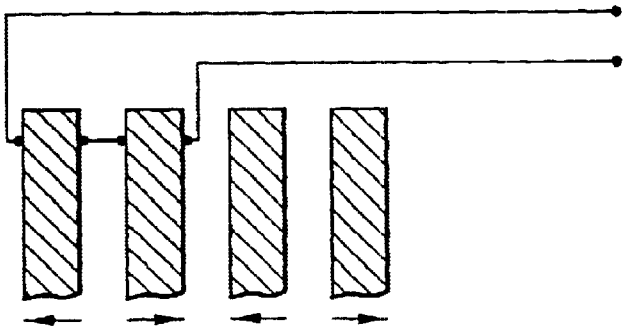
Figure 5E:
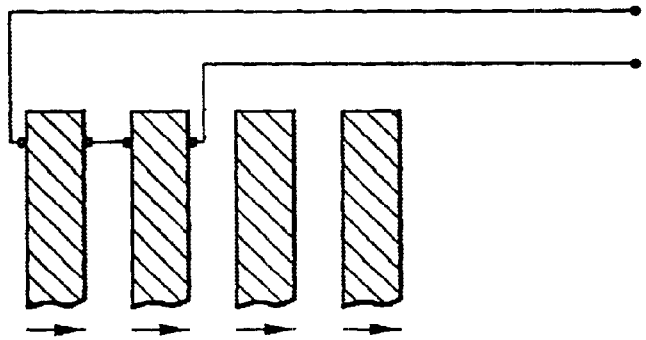
FIGS. 5E–5H show the receiver of FIGS. 5A and 5B with polarization and electrical connections for hydrophone configuration.
Figure 5F:
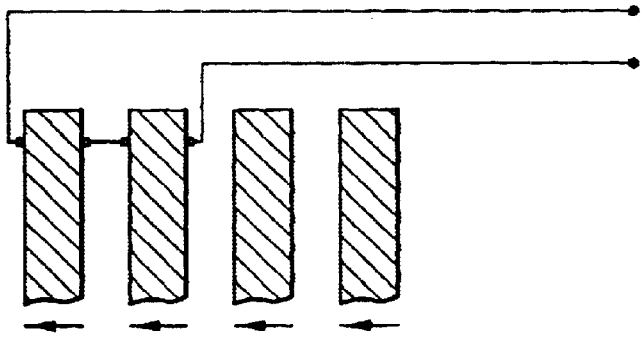
Figure 5G:
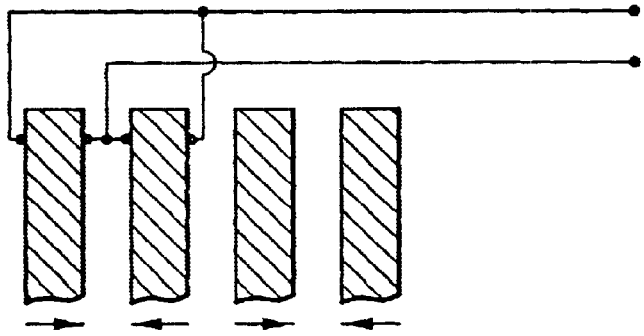
Figure 5H:
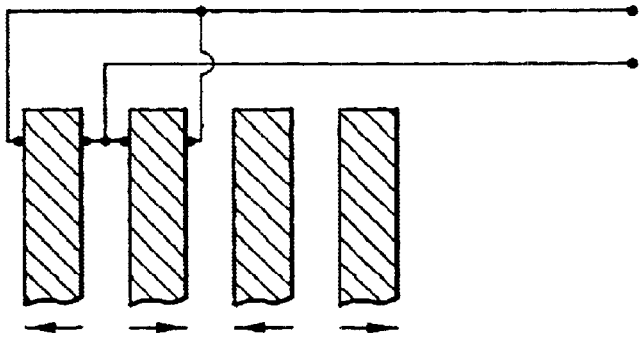

Connecting output terminals and conductive coatings as shown in FIG. 5C or 5D would cause the receiver to operate on a hydrophone mode, with a less desirable low-frequency response.

FIG. 4A shows shell 120 clamped between end plates 151 and 152. End plates 151 and 152 are preferably made of steel. The end plates serve as protective end caps, and provide mechanical support to the shell. Teflon plates 153 and 154, located between the plates and the shell, provide electrical insulation between the steel plates and the conducting surfaces of the shell. The Teflon also prevents acoustic waves from passing directly in fill-fluid from one side of the spiral strip to the other. The two plates are clamped together by bolt 155, nuts 156 and 158, and lock nuts 157 and 159, to form transducer assembly 140.

Transducer assembly 140 is enclosed within bellows assembly 171 and protective butyl rubber housing 178 to make bender-type receiver 100.

Shell 120 is mounted between the flat surfaces of Teflon plates 153 and 154, the flat surfaces providing a sealing contact with the flat axial end surfaces of the shell. The enclosure in which transducer 140 is mounted is filled with fill-fluid, the fill-fluid occupying all spaces between the coils of the shell. Note that elongated spiral slot 130 and the Teflon plates define a closed cavity 131, entirely filled with fill-fluid 177.

Electrical connections are made to the several coatings by welds and wires or by conventional metallic caps as discussed above for the first embodiment. If welds and wires are used, pass-through seals (not shown) in an endplate are used to provide electrical connections between wires within closed cavity 131 and terminals 141 and 142 outside the cavity.

As in the first embodiment, flat axial end surfaces on both sides of the shell have no metallic coating and are in contact only with Teflon plate, so as to maintain electrical isolation between the several conductive coatings.

When a pair of end plates are attached to piezoelectric shell 120, the plates cover open areas of the slot to form a closed cavity containing interior, spiral-shaped, closed-loop surface 132. This cavity is filled with a fill-fluid. Note that after the end plates are attached, after elongated spiral cavity 131 is filled with a fill-fluid, and after exterior conductive coating 133 is surrounded by fill-fluid, there is no open acoustic path through fill-fluid between exterior conductive coating 133 and interior conductive coating 134. The absence of such path (in contrast to the first receiver embodiment which has a narrow, elongated path) further improves low-frequency performance.

Outer and inner portions 121 and 122 of piezoelectric shell 120 are radially polarized in the manufacturing process by applying a strong electric field between conductive coatings 133 and 134 to polarize portion 121, and between conductive coatings 135 and 136 to polarize portion 122. Polarization directions are shown in FIG. 5A. Polarization direction of shell outer spiral portion 121 is indicated by arrow 137. Polarization direction of shell inner spiral portion 122 is indicated by arrow 138. FIG. 5A produces a parallel bender configuration. Reversal of polarization, as shown in FIG. 5B, also a parallel bender configuration, would simply reverse the polarity of the output signal across first and second output terminals 141 and 142.

FIGS. 5C and 5D show the receiver of FIGS. 5A and 5B with polarization and electrical connections for serial bender configuration.

FIGS. 5E–5H show the receiver of FIGS. 5A and 5B with polarization and electrical connections for hydrophone configuration.

Elongated spiral cavity 131 is filled with fill-fluid, preferably castor oil, before the shell is clamped between plates. Clamping the shell between the plates seals the fill-fluid in cavity 131 defined by slot 130.

FIG. 5A also shows electrical wire 143 connecting via weld 144 to exterior conductive coating 133. Likewise, electrical wire 145 connects via weld 146 to interior conductive coating 134.

In this second receiver embodiment, piezoelectric shell 120 is approximately 2 cm in maximum diameter, and is approximately 6 mm wide. The thickness of each of the shell outer and inner portions 121 and 122, is approximately 1.2 mm, and gap 147 between these outer and inner portions is approximately 1 mm wide. Gap 148 between successive spiral coils of piezoelectric shell 120 is approximately 1.2 mm. In a preferred embodiment, the spiral-shaped strip has approximately 1.5 turns, and preferably a number of turns between 1.1 and 3.0. The maximum diameter and the width of piezoelectric shell 120, the thickness of the elements, the gap between the elements, and the number of turns can be selected to meet design requirement specifications for bandwidth, sensitivity, and electric noise.

FIGS. 5B–5H show alternative polarization and wiring configuration.

In the second receiver embodiment, the plates can be made thinner. This is an advantage because the sensitivity of a bender-type piezoelectric sensor increases as the ratio of radius to thickness increases.

Making the Second Receiver Embodiment

The preferred method of making a spiral piezoelectric shell is to cut a solid disk of piezoelectric material using a diamond-impregnated wire.

Polarizing shell outer spiral portion 121 and shell inner spiral portion 122 requires applying the conductive coatings to each of outer and inner shell portions, and applying a high voltage across the coatings of each of outer and inner shell portions before the electrical connections in FIG. 5 are made.

First Transmitter Embodiment

Figure 6A:
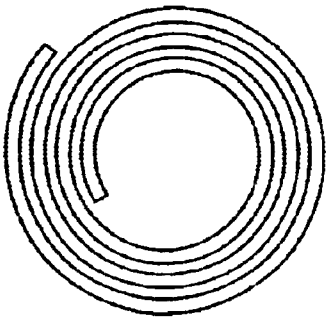
FIGS. 6A and 6B show, respectively, a spiral piezoelectric shell of a piezoelectric receiver, and a spiral piezoelectric shell of a piezoelectric transmitter, illustrating the relative size of the two shells.
Figure 6B:
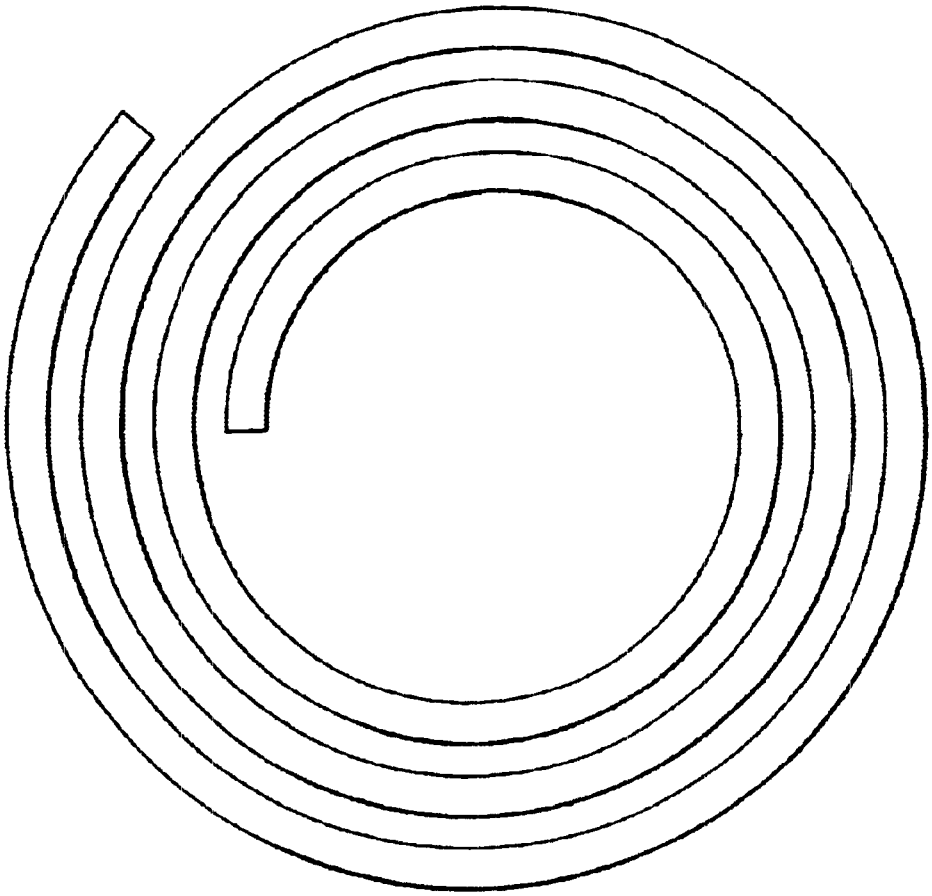

The first transmitter embodiment includes a larger shell than the shell used in the first receiver embodiment. The relative size of the two shells is shown in FIGS. 6A and 6B. FIG. 6A shows the receiver shell. FIG. 6B shows the transmitter shell. Apart from being larger in size, the structure of the transmitter embodiment is similar to the structure of the first receiver embodiment shown in FIG. 2A.

One difference is that resilient rubber gaskets are required between the shell and the end plates to provide a proper acoustic seal between fill-fluid outside and inside the transducer enclosure.

In the first transmitter embodiment, the shell is approximately 7.5 cm in maximum diameter, and the spiral-shaped strip is approximately 1.2 cm wide and 2.5 mm thick. The gap between spiral layers is approximately 3 mm. In a preferred embodiment, the spiral-shaped strip has approximately 2.5 turns, and preferably a number of turns between 1.5 and 3 turns. As in the first receiver embodiment, the maximum diameter, the width and thickness of the spiral strip, the gap, and number of turns can be selected to meet design requirement specifications for bandwidth, sensitivity, and electric noise.

Second Transmitter Embodiment

The second transmitter embodiment is similar in structure to the first transmitter embodiment, except that it uses a shell of the type shown in FIGS. 4A and 4B.

Test Results

Figure 7:
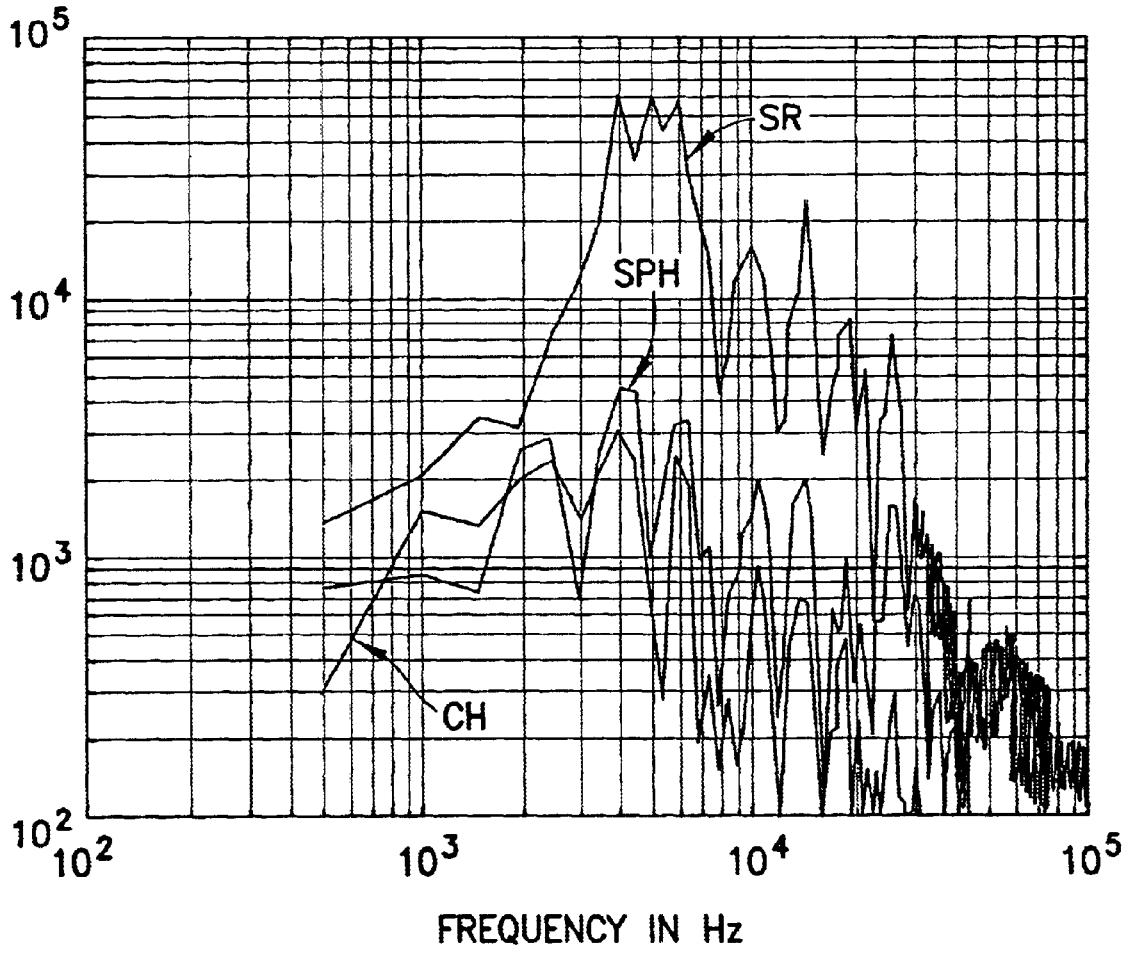
FIG. 7 is a graph comparing the spectral response of the receiver of the first embodiment to the spectral response of a cylinder hydrophone and a stacked plates hydrophone.

FIG. 7 compares the spectral response to a 4 kHz center frequency pulse of the spiral receiver (SR) to the spectral response of a cylinder hydrophone (CH) and a stacked-plates hydrophone (SPH).

Benefits of the Invention

The invention, by virtue of using a spiral-shaped piezoelectric shell having more than one turn, provides an acoustic transducer having a larger surface area and a more flexible piezoelectric member than a cylindrical-shape transducer of similar size. The larger surface area provides a higher capacitance. In a receiver embodiment, when a charge amplifier is used, the larger surface area provides a sensitivity improvement, approximately in proportion to the increase in surface area.

The invention, by virtue of the spiral-shaped piezoelectric shell having a free inner end (i.e., an end that is not physically constrained), provides a piezoelectric shell that has more flexibility than a cylindrical shape hydrophone of similar size. In a receiver embodiment, this provides additional sensitivity improvement.

The invention provides an acoustic transducer having a higher electrical capacitance than a cylindrical transducer of similar size. This makes a receiver embodiment that is less affected by the electric load of the cable, and less sensitive to spurious electromagnetic energy.

The invention provides an acoustic transducer having a a spiral-shaped piezoelectric transducer that can be free-flooded to withstand the high ambient pressures encountered in underwater, marine seismic, and oil well applications.

The invention provides an acoustic transducer having a spiral-shaped piezoelectric shell operating in bender mode with a large radius/thickness ratio. In the receiver embodiment, this provides additional sensitivity improvement.

What is claimed is:

1. An acoustic transducer, comprising:

a polarized piezoelectric shell having a first spiral-shaped surface and a second spiral-shaped surface, wherein said shell defines an exterior spiral-shaped surface and a spiral slot, the slot defining an interior spiral-shaped surface, wherein said first spiral-shaped surface is at least a portion of said exterior spiral-shaped surface, and wherein said second spiral-shaped surface is at least a portion of said interior spiral-shaped surface;

a first terminal electrically coupled to said first spiral-shaped surface; and a second terminal electrically coupled to said second spiral-shaped surface.

2. An acoustic transducer according to claim 1, further comprising a pair of plates attached to the shell, the plates covering open areas of the slot to form a closed cavity having an interior spiral surface.

3. An acoustic transducer according to claim 2, wherein said closed cavity contains a fill-fluid.

4. A piezoelectric shell cut from a block of piezoelectric material, the shell having an exterior spiral-shaped surface and a spiral slot, the slot defining an interior spiral-shaped surface, wherein said shell has a first spiral-shaped surface which is at least a portion of said exterior spiral-shaped surface, and wherein said shell has a second spiral-shaped surface which is at least a portion of said interior spiral-shaped surface.

5. A piezoelectric shell according to claim 4, the shell having a pair of flat axial end surfaces orthogonal to the spiral-shaped surfaces.

6. A piezoelectric shell according to claim 4, the spiral-shaped surfaces each having a linear axial cross section.

* * * * *